US005533639A

United States Patent [19]

Myers

[11] Patent Number: 5,533,639

[45] Date of Patent: Jul. 9, 1996

[54] COMESTIBLE AND LIQUID CONTAINER CARRIER

[76] Inventor: William H. Myers, 29702 Avante, Laguna Niguel, Calif. 92677

[21] Appl. No.: 423,936

[22] Filed: Apr. 18, 1995

[51] Int. Cl.[6] ..... B65D 21/02

[52] U.S. Cl. ..... 220/23.8; 220/524; 220/526; 220/556

[58] Field of Search ..... 426/110; 206/216, 206/45.33; 220/6, 23.8, 23.83, 23.86, 505, 522, 524, 526, 555, 556, 575, 737, 738, 759

[56] References Cited

U.S. PATENT DOCUMENTS

| | | | |
|---|---|---|---|
| 3,061,136 | 10/1962 | Sterngart | 220/23.8 |
| 3,094,264 | 6/1963 | Petrone . | |
| 3,113,817 | 12/1963 | Imel | 220/23.83 |
| 3,139,208 | 6/1964 | Irwin et al. | 220/23.8 |
| 3,201,024 | 8/1965 | Brokop . | |
| 3,498,523 | 3/1970 | Stembridge et al. . | |
| 3,565,323 | 2/1971 | Katzenmeyer . | |
| 3,640,380 | 2/1972 | Huffman . | |
| 4,155,502 | 5/1979 | Forte . | |
| 4,253,572 | 3/1981 | Halbich | 220/524 |
| 4,397,393 | 8/1983 | Pergande et al. | 206/216 |
| 4,895,259 | 1/1990 | Paley . | |
| 5,052,557 | 10/1991 | Contino et al. . | |
| 5,071,007 | 12/1991 | Kadien . | |
| 5,119,940 | 6/1992 | Grindrod | 206/45.31 |
| 5,165,583 | 11/1992 | Kouwenberg . | |
| 5,167,325 | 12/1992 | Sykora . | |

FOREIGN PATENT DOCUMENTS

| | | |
|---|---|---|
| 0473266A1 | 3/1992 | European Pat. Off. . |

*Primary Examiner*—Stephen J. Castellano
*Attorney, Agent, or Firm*—Richard C. Litman

[57] ABSTRACT

A combined comestible and liquid container carrier having a unitary base with a central, inverse frustoconically shaped sleeve for receiving a liquid container, and two symmetrically disposed depressions, each for receiving a comestible. Each depression has a lid connected to it by a living hinge structure. When closed, the inboard side edge wall of each lid is an extension of the sleeve, such that a container inserted into the sleeve will be complementarily received by both the sleeve and lid edge.

10 Claims, 3 Drawing Sheets

COMESTIBLE AND LIQUID CONTAINER CARRIER

BACKGROUND OF THE INVENTION

1. Field of the Invention

This invention relates to packaging. Specifically, the present invention relates to comestible and liquid container carriers.

2. Description of the Prior Art

Disposable comestible and liquid container carriers, referred to hereinafter as carriers, come in multitudinous shapes and sizes. Continued growth and commercial competition within the convenience food industry has generated intense research and development in carrier art.

U.S. Pat. No. 3,094,264, issued Jun. 18, 1963, to J. Petrone, describes a carrier comprising an elongated trough for receiving foodstuff, such as a hot dog, and having at one end of the trough a panel which extends across the trough. The panel has a bore therethrough for receiving a liquid container. Petrone's invention fails to provide an enclosure for comestible containment or sleeves for liquid container containment. Petrone's invention also has no pivotable closures.

U.S. Pat. No. 3,201,024, issued Aug. 17, 1965, to A. Brokop, describes a handled carrier or tray for receiving foodstuff and liquid containers. As in the case with Petrone's invention, Brokop's invention fails to provide an enclosure for comestible containment or sleeves for liquid container containment and has no pivotable closures. Brokop's invention has a handle at each end of the tray which restrict both of the user's hands. Conversely, the present invention provides a superposed, singular handle.

U.S. Pat. No. 3,498,523, issued Mar. 3, 1970, to W. F. Stembridge et al., describes a carrier comprising a plurality of sleeves for receiving liquid containers and a superposed, singular handle. Stembridge's invention also fails to provide for hinged closures to contain foodstuff. Stembridge's handle is configured to hang liquid containers, rather than as a circumscribing means to discourage dislodgement of the liquid containers.

U.S. Pat. No. 3,565,323 issued Feb. 23, 1971, to J. H. Katzenmeyer, describes a carrier that is a cross between Stembridge's and Brokop's inventions: panels with bores therethrough which receive liquid containers and a centrally superposed singular handle. Similar to the above references, Katzenmeyer invention fails to provide for comestible containment, sleeves for receiving liquid containers, or a wrap-around handle.

U.S. Pat. No. 3,640,380 issued Feb. 8, 1972, to W. W. Huffman, describes a carrier comprising a box with a roof-like top having an apex. A handle extends upward from the apex. Huffman's invention provides rings from which to hang liquid containers. The rings are separated along blanked perforated lines and folded up to receive liquid containers. Huffman's invention fails to provide for comestible containment, sleeves for receiving liquid containers, or a wrap-around handle.

U.S. Pat. No. 4,155,502, issued May 22, 1979, to R. L. Forte, describes a carrier made up of dual, cooperative panels disposed at an acute angle to each other, each having bores therethrough for receiving and frictionally engaging liquid containers, and a centrally superposed singular handle. Forte's invention fails to provide for comestible containment, sleeves for receiving liquid containers, or a wrap-around handle.

U.S. Pat. No. 4,895,259 issued Jan. 23, 1990, to S. D. Paley, describes a carrier comprising dual wells, a deep well for retaining elongated foodstuffs and a shorter well including a panel for receiving a liquid container. The shorter well includes a panel having a bore therethrough to secure the liquid container. As in the case of the above-discussed references, Paley's invention fails to provide for comestible containment, sleeves for receiving liquid containers, or a wrap-around handle.

U.S. Pat. No. 5,052,557 issued Oct. 1, 1991, to F. L. Contino et al., describes a carrier comprising a tray with pockets for receiving liquid containers and pivoting closures which, when closed, contain the liquid containers. The closures have apertures which come into registration and define a superposed singular handle. Contino's invention, although providing pockets, fails to provide a lipped tray capable of containing contents deposited therein. Contino's invention also does not provide separate accommodations for items having different temperature requirements.

U.S. Pat. No. 5,071,007 issued Dec. 10, 1991, to T. G. Kadien, describes a carrier comprising a panel having a bore therethrough for receiving liquid containers and a second panel on which the liquid containers may rest. Kadien fails to provide for comestible containment or sleeves for receiving liquid containers.

U.S. Pat. No. 5,165,583 issued Nov. 24, 1992, to R. J. C. Kouwenberg, describes a two-piece carrier wherein the bottom half has a plurality of insulated sleeves for receiving liquid containers. The top half has a cap including a like number of insulated sleeves which, when the top and bottom halves are mated, are in registration with the sleeves in the bottom half. Kouwenberg's invention does not have hinged closures nor does it provide for inviolate comestible containment while permitting accessibility to a liquid container stored therein.

U.S. Pat. No. 5,167,325 issued Dec. 1, 1992, to J. M. Sykora, describes a carrier comprising an open sided, box-shaped structure. The top of the box has bores therethrough for receiving bottle necks. The closed sides of the box have apertures for receiving a portion of a bottle bottom. Sykora's invention fails to include closures for comestible containment or a wraparound handle.

European Patent No. 0 473 266 A1 published Mar. 4, 1992, and issued to A. Saulas, describes a box-like carrier having a handle. Saulas' invention fails to provide a sleeve for receiving a liquid container or a wrap-around handle.

None of the above references, taken alone or in combination, are seen as teaching or suggesting the presently claimed carrier.

SUMMARY OF THE INVENTION

The present invention is a combined comestible and liquid container carrier having a unitary base with an inverse, frustoconical receptacle for receiving a liquid container, at least one depression for receiving a comestible, and a like number of closures as depressions.

The sleeve, preferably, has the inverse frustoconical shape to nestingly receive a similarly shaped liquid container.

Each closure is disposed adjacent to a designated depression and outboard of the center of the container, and has a living hinge connection to the depression. Each closure may be articulated to a closed position thereby defining, with the depression, a compartment. Further, when closed, an outer surface of the closure is defined by a projection of the inverse frustoconical sleeve such that a container inserted into the sleeve will be complementarily received by both the sleeve and closure.

The carrier may be cradled by a band having generally vertical side portions. Each side portion may have an aperture in registration with the other aperture, which together define a fingers/thumb graspable handle.

In consideration of the above, an object of the invention is to provide a carrier which provides separate containment of comestibles and a liquid container.

Another object of the invention is to provide a carrier which provides firm, noncompressive liquid container retention.

A further object of the invention is to provide a carrier which is balanced and promotes spill-proof conveyance.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
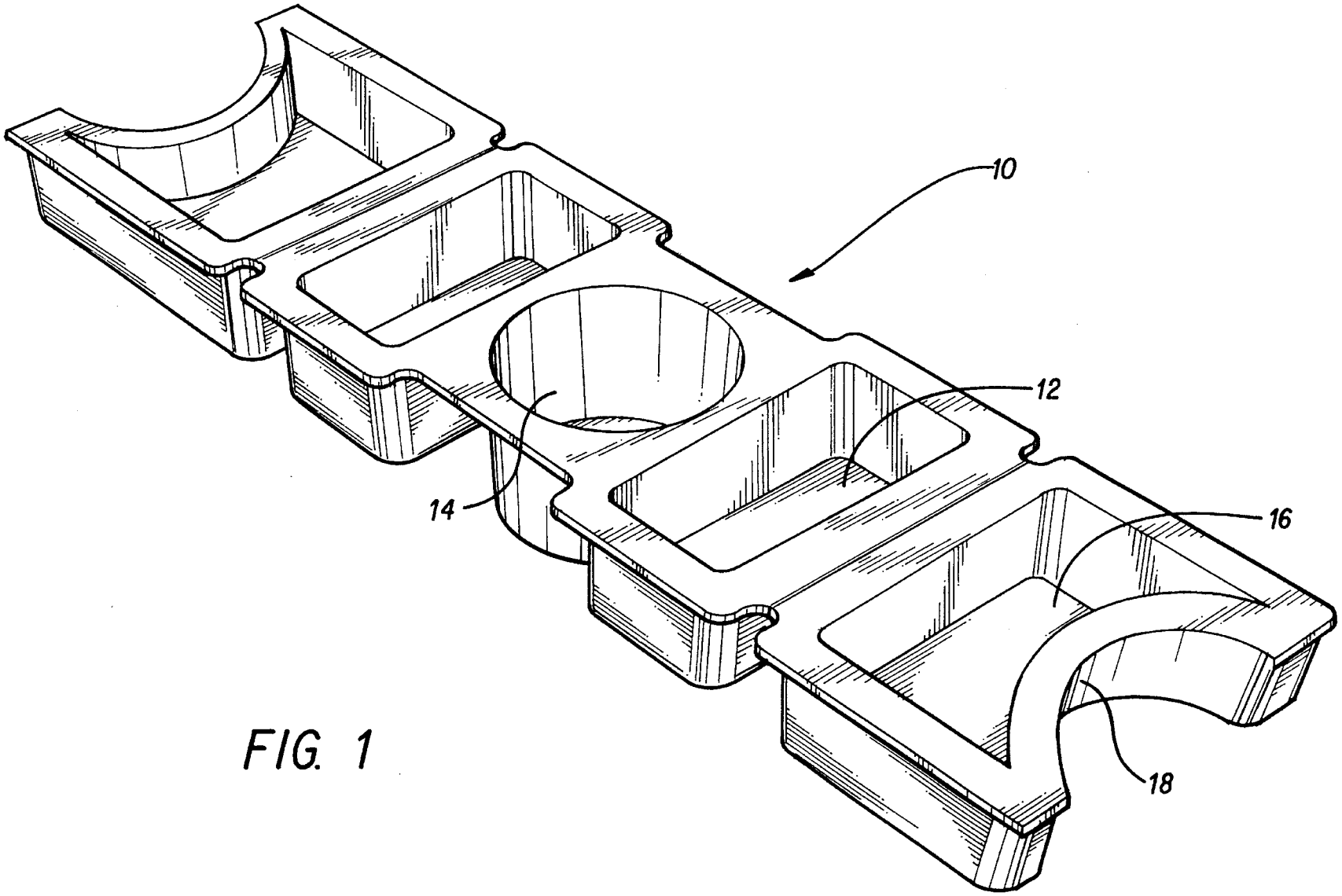
FIG. 1 is a front perspective view of an embodiment of the invention with opened closures or lids.
Figure 2:
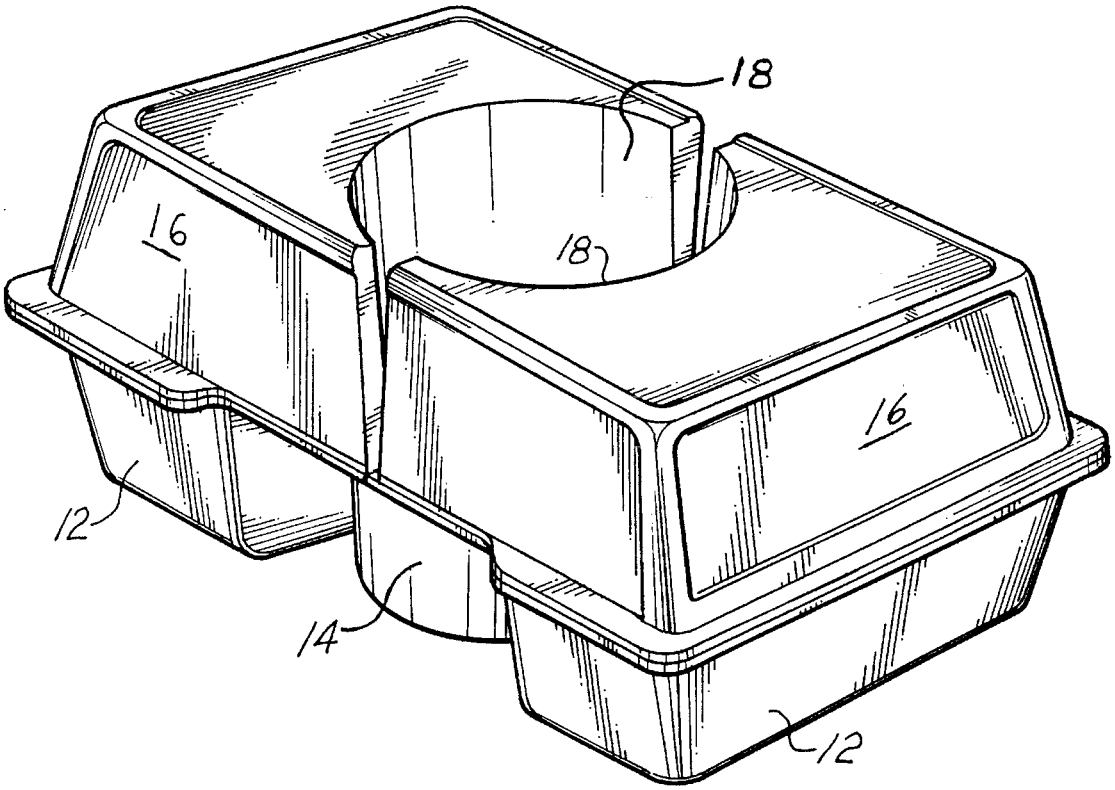
FIG. 2 is a front perspective view of an embodiment of the invention with articulated lids closed.

Referring to FIG. 1, the invention is shown having a unitary base 10 which may be formed from any semi-rigid material, with or without insulative capacity, such as, but not limited to: a polystyrene, including methyl polystyrene, ethyl polystyrene and variants thereof; polyethylene terephthalate; a polyolefin including branched or linear polyethylene, polypropylene and so forth; or the like. Base 10 should be rigid enough so that it will not cut or bend under the weight of the comestibles being transported. In one preferred embodiment, the material will be of closed cell construction to promote insulation.

Base 10 includes two depressions 12 having downwardly sloping walls which are easily manufactured and render the containers nestable for shipping and storage. Also, the insulative capability of the depression floors and walls should discourage heat transfer to or from a comestible contained therein.

Base 10 also includes a sleeve 14 also having downwardly sloping walls for manufacturing and storing ease. The slope of the walls may be configured to complementarily and securely receive and possibly insulate the base and a portion of frustoconical surface of a liquid container.

Closures 16 are shown molded integrally with base 10. These closures, preferably, have downwardly sloping walls. Closures 16 are shown hinged in living hinge fashion at the outside edges of base 10. Thus, closures 16 are capable of folding toward sleeve 14 to a closed position.

Referring to FIG. 12, when closures 16 are in the closed position, closure 16 comes into registration with depression thereby defining, in combination with depression 12, a closed compartment for securing comestibles therein. Closure walls 18 may be configured to complementarily and securely receive and insulate a portion of the frustoconical surface of a liquid container C. The device can be configured such that insertion of a frustoconically-shaped liquid container into sleeve 14 and between walls 18 may operate to wedge closures 16 closed, discouraging spilling of contents contained within depressions 12.

Figure 3:
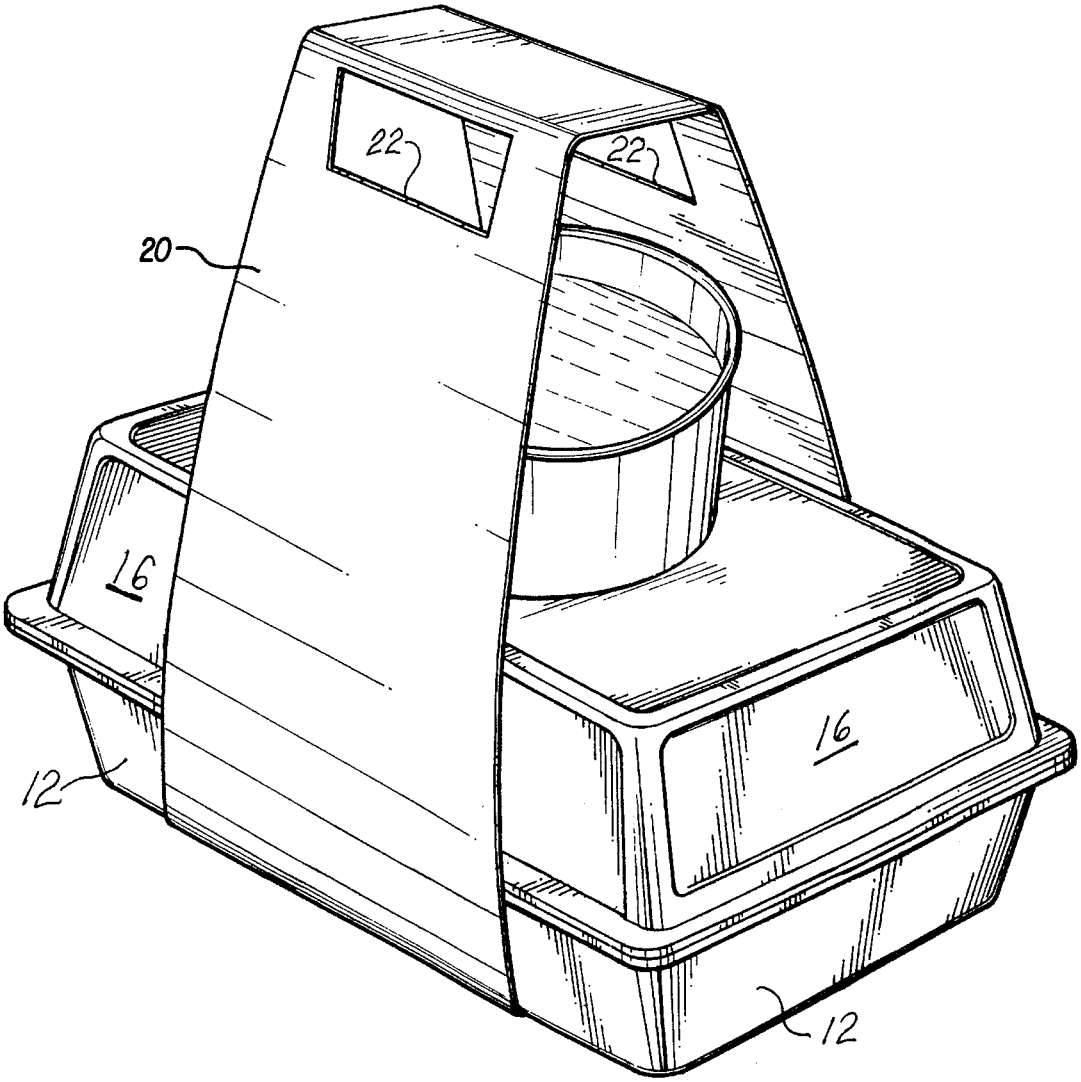
FIG. 3 is an environmental perspective view of an embodiment of the invention with a handle carrying a liquid container.

Referring to FIG. 3, a detachable band 20 having two generally vertical surfaces is shown cradling base 10. Each vertical surface of band 20 may have an aperture 22 in registration with aperture 22 of the other generally vertical surface thereby defining a handle. Band 20 is located approximately above the center of gravity of the container, comestibles and liquid to provide for balanced conveyance which decreases risks of spillage.

The present invention is not intended to be limited to the sole embodiment described above, but to encompass any and all embodiments within the scope of the following claims.

I claim:

1. A comestible and liquid container carrier comprising:

a unitary base having a primary depression and at least one secondary depression, there further being a lid for said secondary depression;

a carrying band dimensioned and configured to cradle said base, said band including first and second generally vertical surfaces having apertures therein defining a handle;

means defining a hinge between said secondary depression and said lid;

wherein said lid may be pivoted about said hinge between an open position and a closed position, said lid and said second depression defining a compartment.

2. A carrier according to claim 1, wherein said primary depression has an inverse, frustoconical configuration.

3. A carrier according to claim 1, said lid having a depression and dimensioned to have a height about the same as that of said secondary depression.

4. A carrier according to claim 1, said lid, when closed, having an interior side wall configured as an extension of a side wall of said primary depression.

5. A comestible and liquid container carrier comprising:

a unitary base having a primary depression and a pair of secondary depressions;

said primary depression having an inverse, frustoconical configuration;

a pair of lids, one for each secondary depression;

means defining a living hinge between each said secondary depression and each said lid;

said primary depression having a primary wall surface, said lid, when closed, having an edge defined by a projection of said primary depression wall surface;

wherein each said lid may be pivoted about each said hinge between an open position and a closed position, each said lid and each said second depression defining a compartment; and a carrying band dimensioned and configured to cradle said base.

6. A carrier according to claim 5, each said lid having a depression therewithin and dimensioned to have a height about the same as that of its secondary depression.

7. A carrier according to claim 5, said band further having first and second generally vertical surfaces, said surfaces each having apertures which, in registration, define a handle.

8. A comestible and liquid container carrier comprising:

a unitary base having a primary depression and a pair of secondary depressions;

a carrying band dimensioned and configured to cradle said base;

said band including first and second generally vertical surfaces having apertures defining a handle;

a pair of lids, one for each secondary depression;

means defining a living hinge between each said secondary depression and each said lid;

said primary depression having a primary wall surface, said lid, when closed, having an edge defined by a projection of said primary depression wall surface;

wherein each said lid may be pivoted about each said hinge between an open position and a closed position, each said lid and each said second depression defining a compartment.

9. A carrier according to claim 8, wherein said primary depression has an inverse, frustoconical configuration.

10. A carrier according to claim 8, each said lid having a depression therewithin and dimensioned to have a height about the same as that of its secondary depression.

* * * * *